United States Patent [19]

Frantz

[11] 4,402,564

[45] Sep. 6, 1983

[54] LOCKING FLAT FLEXIBLE CABLE TO CIRCUIT BOARD CONNECTOR

[75] Inventor: Robert H. Frantz, Carlisle, Pa.

[73] Assignee: AMP Incorporated, Harrisburg, Pa.

[21] Appl. No.: 273,695

[22] Filed: Jun. 15, 1981

[51] Int. Cl.[3] ..... H01R 13/62

[52] U.S. Cl. ..... 339/91 R; 339/17 F; 339/103 M; 339/176 MF

[58] Field of Search ..... 339/17 F, 97 R, 97 P, 339/176 MF, 91 R, 97 C, 103 R, 103 M, 107

[56] References Cited

U.S. PATENT DOCUMENTS

| | | | |
|---|---|---|---|
| 3,179,738 | 4/1965 | DeLyon | 174/50 |
| 3,594,696 | 7/1971 | Witek, Jr. | 339/91 R |
| 3,601,760 | 8/1971 | Cairns | 339/91 R |
| 3,605,070 | 9/1971 | Krafthefer | 339/91 R |
| 3,696,319 | 10/1972 | Olsson | 339/17 F |
| 3,795,885 | 3/1974 | Desso et al. | 339/17 F |
| 3,820,055 | 6/1974 | Huffnagle et al. | 339/17 F |
| 3,864,000 | 2/1975 | Coller et al. | 339/17 LC |
| 3,873,172 | 3/1975 | Paullus | 339/176 MF |
| 4,082,402 | 4/1978 | Kinkaid et al. | 339/97 C |
| 4,111,512 | 9/1978 | Parmer et al. | 339/103 M |
| 4,186,982 | 2/1980 | Cobaugh et al. | 339/17 C |
| 4,200,350 | 4/1980 | Zimmerman, Jr. | 339/91 R |
| 4,211,466 | 7/1980 | Reynolds | 339/176 MF |

FOREIGN PATENT DOCUMENTS

| | | | |
|---|---|---|---|
| 2138462 | 2/1973 | Fed. Rep. of Germany | 339/97 R |

*Primary Examiner*—John McQuade
*Assistant Examiner*—Gary F. Paumen
*Attorney, Agent, or Firm*—Russell J. Egan

[57] ABSTRACT

The subject connector lockingly interconnects flat flexible cable with fixed terminals of a printed circuit board or the like. The connector has a receptacle member which is mounted on and secured to the printed circuit by pin portions of receptacle terminals extending from the receptacle member. The mating plug is designed to receive a flat flexible cable therein with the cable being terminated by crimped on pin terminals. The plug both provides a shroud receiving the receptacle therein and encloses and protects the pin terminals. The plug provides locking intermating with the receptacle member and locking retention of the cable so that it cannot be unintentionally removed from the plug.

2 Claims, 7 Drawing Figures

LOCKING FLAT FLEXIBLE CABLE TO CIRCUIT BOARD CONNECTOR

The present invention relates to a connector for interconnecting flat flexible cable with a printed circuit board and in particular to a connector providing locked mating.

The present invention is an improvement over the connector described in my co-pending U.S. patent application Ser. No. 165,317 filed July 2, 1980, and now abandoned.

Previously there have been difficulties in interfacing flat flexible cable with printed circuit boards. The prior art is represented by U.S. Pat. No. 3,795,885 which shows an adapter which provides only a limited amount of strain relief and is open in the crimp area. This reference connector also requires the pin terminals to be bent normal to their longitudinal axis in order to accommodate a right angle connection. This prior art device is deficient in providing locked intermating of the plug and receptacle portions of the connector as well as strain relief for the cable.

The present invention concerns means to lockingly interconnect a plug terminating multiple conductor flat flexible cable with a circuit board mounted receptacle while providing strain relief for the cable in the plug. The receptacle member has opposed, spaced mounting and mating faces with terminal passages extending therebetween. The receptacle member also has at least one outwardly directed locking lug. A receptacle terminal is mounted in each passage with a receptacle portion directed towards the mating face and a mounting tail portion extending from the mounting face to be secured to an appropriate aperture and conductive path of a circuit board or the like. The mating plug member has a housing with an elongated opening in a cable receiving chamber and an oppositely directed mating face enclosed in a profiled shroud adopted to be received around the receptacle member and lockingly engaged therewith. Pin terminals used to terminate the flat flexible cable each have a crimp portion crimpingly engaging a respective conductor of the cable and a pin portion extending from the mating face to be enclosed with the shroud.

It is therefore an object of the present invention to produce an improved electrical connector for making a locked interconnection between flat flexible multiple conductor cable and a circuit board or the like.

It is another object of the present invention to provide a plug for flat flexible multi-conductor cable which will enclose crimped portions of pin terminals terminating conductors of the cable and provide strain relief for the cable while also providing a shroud which will enclose and protect the pins extending from the mating face of the plug.

It is another object of the present invention to produce an improved locking electrical connector which can be readily and economically manufactured.

The means for accomplishing the foregoing objects and other advantages of the present invention will be apparent to those skilled in the art from the following detailed description by way of example taken with reference to the accompanying drawings, in which.

Figure 1:
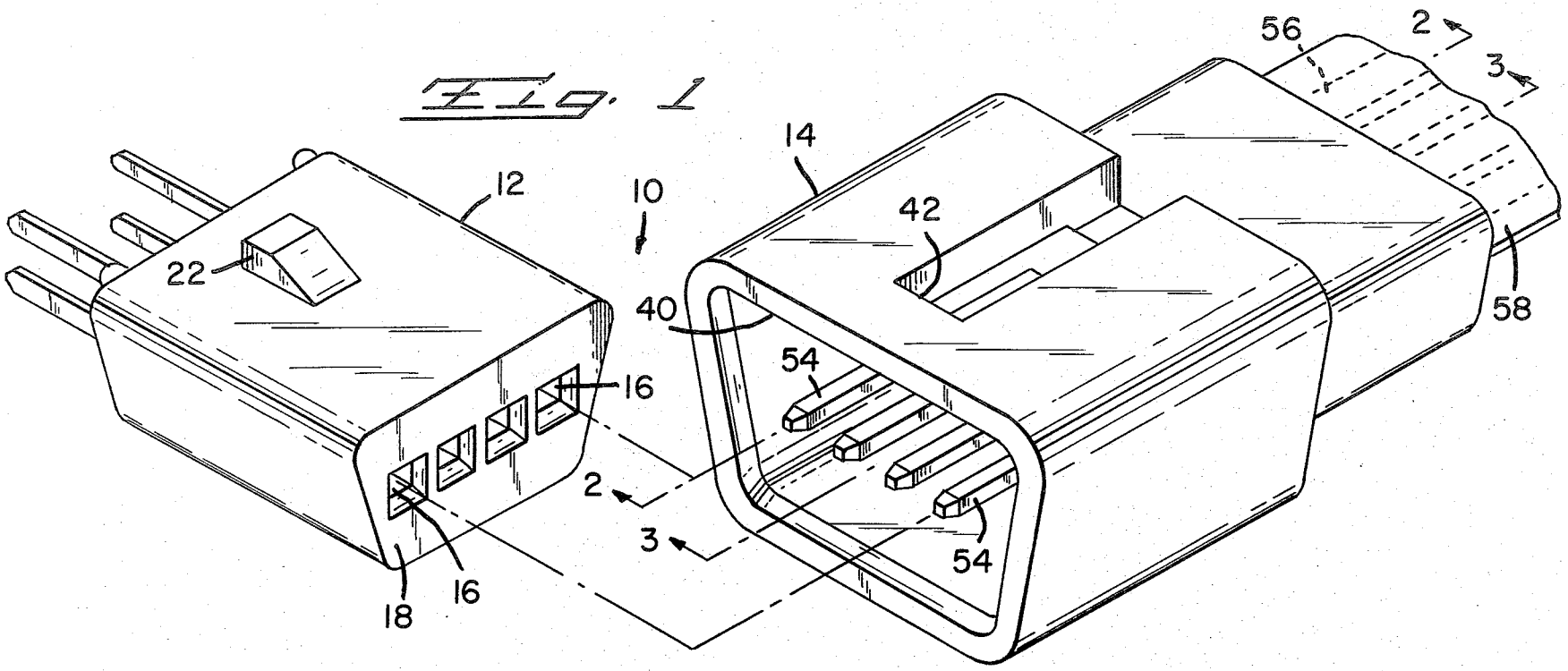
FIG. 1 is an exploded perspective view of an electrical connector according to the present invention.

The subject connector 10 includes a receptacle member 12 and a plug member 14. The receptacle member 12 is adapted to be mounted on a printed circuit board or the like 15 (see FIG. 6). The receptacle member 12 is formed of an insulative material and has a plurality of terminal cavities 16 extending between a mating face 18 and a mounting face 20. The receptacle member 12 also includes at least one outwardly directed locking lug 22. A like plurality of receptacle terminals 24 are provided each having a mounting portion 26 engaging in the passage 16 with a receptacle portion, in this instance being shown as a pair of spaced parallel arms 28, and an oppositely directed mounting tail 30. The mounting tail 30 can either be a flat extension, as shown, or have profiled action and reaction surfaces as shown in U.S. Pat. No. 4,186,982, the disclosure of which is incorporated herein by reference.

Figure 3:
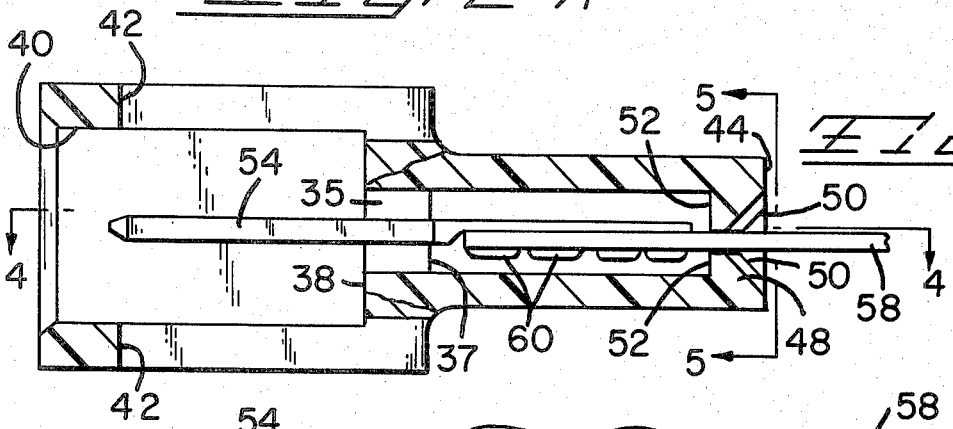
FIG. 3 is a vertical transverse section taken along line 3—3 of FIG. 1.
Figure 5:
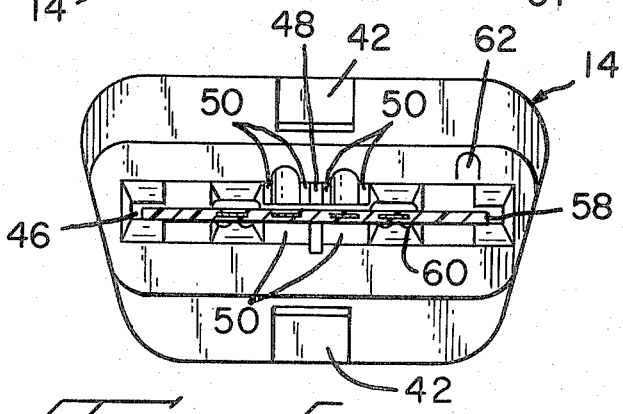
FIG. 5 is a rear elevation, partially in section, taken along line 5—5 of FIG. 3.

The mating plug 14 has a generally rectangular housing 32 defining a chamber 34 therein with a plurality of passageways 35, 36 extending from a rear surface 37 to open onto a mating face 38. It can be seen from FIG. 5 that the rear surface 37 is profiled to facilitate entry of the respective terminal pins 54 into the passageways 36. mating face 38 is surrounded by a forwardly extending shroud 40 having at least one mating locking recess 42 aligned to engage with a respective locking lug 22 of the receptacle member. The rear face 44 of the plug is provided with an elongated profiled slit 46 (see FIG. 5). The profiling of the slit includes at least one pair of inwardly directed teeth 48 which are profiled to have an inwardly and rearwardly directed taper 50 (see FIG. 3) and an inwardly directed sharp shoulder 52. The upper two teeth 48 are also shown with a longitudinal concavity 49.

Pin terminals 54 are used to terminate each of the respective conductors 56 of a flat flexible multiconductor cable 58 with each terminal 54 being crimped to an appropriate conductor by means of the crimp tines 60. Preferably, the crimp portion of the terminal is formed in the manner of the crimp configuration shown in U.S. Pat. No. 4,082,402, the disclosure of which is incorporated herein by reference. The pin portion of each terminal 54 is passed through the respective passageway 36 to extend from mating face 38 and lie inside the shroud 40.

Figure 4:
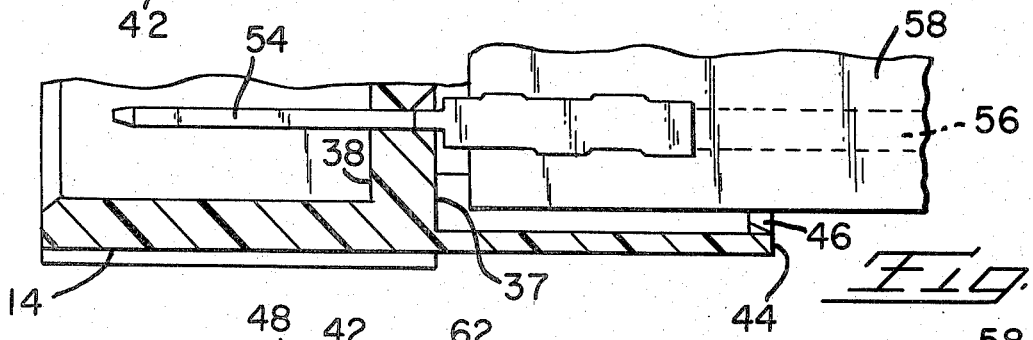
FIG. 4 is a partial section taken along line 4—4 of FIG. 3.

The subject connector is assembled by first mounting the terminals 24 in the respective cavities 16 of the receptacle member 12 and securing them to the circuitry of a circuit board 15 in known fashion. The terminals 54 are crimped to the conductors 56 of the flat cable 58 and the cable is inserted into the slot 46 of the plug 14 until the crimp tines 60 are fully enclosed in the chamber 34. It will be noted from FIG. 3 that in this position the shoulders 52 prevent withdrawal of the cable 58 and terminals 54 from the plug 14 and FIG. 4 shows that the terminals 54 themselves abut against rear surface 37 of the chamber 34 to prevent further forward movement. It will also be noted, from FIG. 5, that the teeth 48 lie behind at least some of the terminals, preferably in a balanced arrangement, so that there will be an even distribution of pulling forces attempting to withdraw the cable from the chamber 34. It is not necessary to have a tooth behind each terminal as such an arrangement would prove to be unnecessary and provide high assembly forces.

Figure 2:
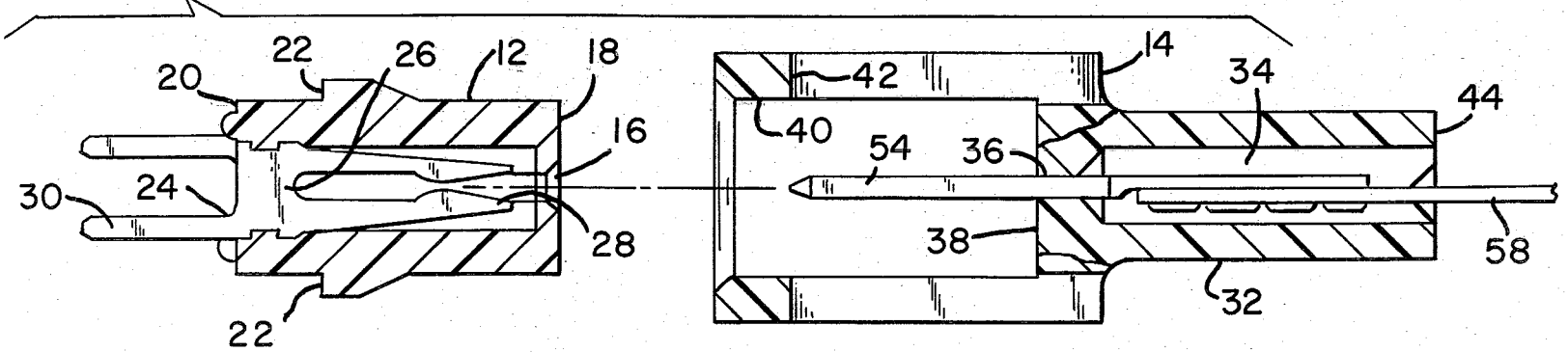
FIG. 2 is a vertical transverse section taken along line 2—2 of FIG. 1 showing the subject connector in an unmated condition.
Figure 2A:
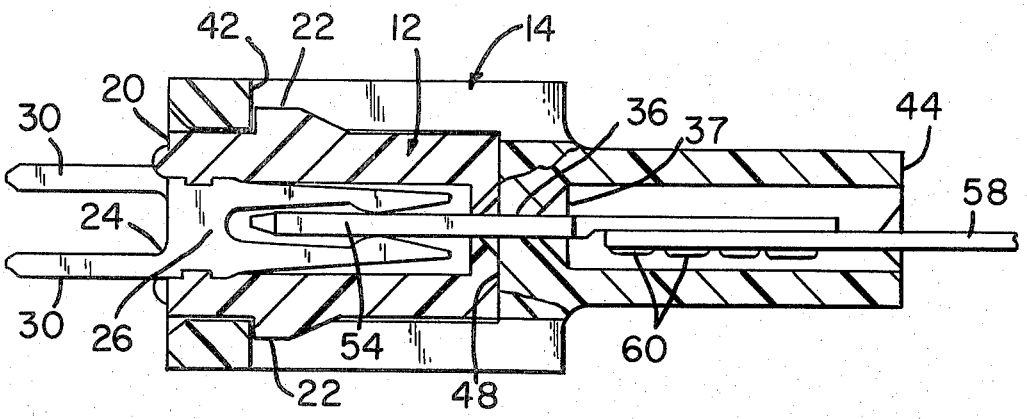
FIG. 2A is a vertical transverse section similar to FIG. 2 showing the subject connector in a mated condition.

The shroud 40 is preferably polarized to have a configuration like that of the receptacle member so that the connector can only be mated on one direction. When fully mated, as shown in FIG. 2, it will be seen that the locking lugs 22 of the receptacle portion 12 engage in the mating locking recesses 42 of the plug 14 to hold the connector in a fully assembled condition.

At this point it should be noted that the rear surface of the plug can include indicia 62 which will indicate the direction of penetration of the crimp of the terminals into the cable. This would assure proper insertion of the cable into the plug.

Figure 6:
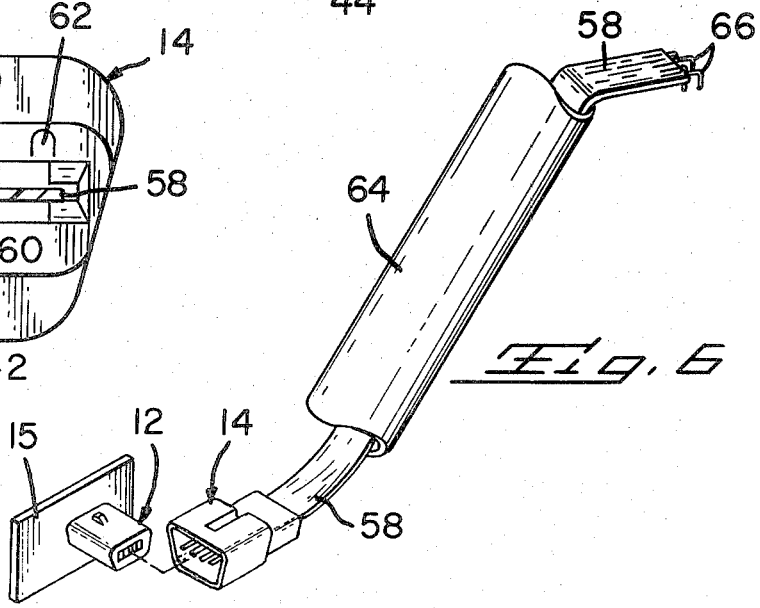
FIG. 6 is a perspective view showing the subject invention as it would be utilized in a steering column of a motor vehicle.

FIG. 6 shows an embodiment of the subject invention as it might be used to add electronics in the steering column 64 of a motor vehicle or the like. The cable 58 would extend up the column through a tunnel-like portion and have terminals 66 at the free end thereof which would be connected to some indicating apparatus or perhaps control device (not shown). The plug of the subject invention would terminate the lower end of the cable to join the remote circuitry to circuitry of the automobile via receptacle 12 and circuit board 15. It will be seen and readily appreciated that the present invention will provide a well secured assembly or when the pieces are mated and locked.

I claim:

1. An electrical connector for interconnecting flat flexible cable with a printed circuit board comprising:

a receptacle member having an elongated housing with a mounting surface, a mating face, a plurality of terminal recesses extending therein from said mounting surface to said mating face, and at least one locking means extending from an outer surface of said receptacle member;

a plurality of receptacle terminals each mounted in a respective one of said recesses with each said receptacle terminal having a body portion including means for holding said receptacle terminal in said recess, a receptacle portion directed towards said mating face and a mounting tail portion extending from mounting surface of said elongated, housing;

a plug member having an elongated body of insulative material defining a mating face, a rear surface, a chamber intermediate said plug member mating face and said rear surface, a cable receiving slot in said rear surface opening into said chamber, a plurality of apertures in said chamber opening on said plug member mating face, an integral shroud surrounding and extending forwardly of said plug member mating face, pairs of opposed inwardly directed teeth profiling said cable receiving slot in a balanced arrangement, and means for engaging said locking means of said receptacle member; and a multi-conductor flat flexible cable having a plurality of pin terminals each crimped to a respective conductor thereof, said cable being mounted through said slot with said pin terminals projecting from said apertures and said teeth engaging rear portions of said terminals to prevent the rearward withdrawal of said cable from said plug member, whereby upon mating of said connector said plug member and receptacle member are locked together by said locking means and said means for engaging said locking means and strain relief is provided for said cable by engagement of said pairs of teeth behind respective pin terminals.

2. An electrical connector according to claim 1 wherein said locking means comprises an outwardly directed lug and said means for engaging said locking means comprises a recess.

* * * * *